US007489228B2

(12) United States Patent
Robert

(10) Patent No.: US 7,489,228 B2
(45) Date of Patent: Feb. 10, 2009

(54) LOW POWER CONSUMPTION BISTABLE MICROSWITCH

(75) Inventor: Philippe Robert, Grenoble (FR)

(73) Assignee: Commissariat a l'Energie Atomique, Paris (FR)

( * ) Notice: Subject to any disclaimer, the term of this patent is extended or adjusted under 35 U.S.C. 154(b) by 292 days.

(21) Appl. No.: 10/561,948

(22) PCT Filed: Jun. 30, 2004

(86) PCT No.: PCT/FR2004/050298

§ 371 (c)(1),
(2), (4) Date: Dec. 22, 2005

(87) PCT Pub. No.: WO2005/006364

PCT Pub. Date: Jan. 20, 2005

(65) Prior Publication Data

US 2006/0152328 A1 Jul. 13, 2006

(30) Foreign Application Priority Data

Jul. 1, 2003 (FR) ..... 03 50278

(51) Int. Cl.
*H01H 37/52* (2006.01)
*H01H 59/00* (2006.01)
*H01P 1/10* (2006.01)

(52) U.S. Cl. ..... 337/89; 337/36; 337/139; 337/141; 337/53; 337/365; 60/529; 310/307

(58) Field of Classification Search ..... 337/36, 337/139, 141, 89, 53, 365; 60/529; 310/307
See application file for complete search history.

(56) References Cited

U.S. PATENT DOCUMENTS 5,536,963 A * 7/1996 Polla ..... 257/417
5,619,061 A * 4/1997 Goldsmith et al. ..... 257/528
6,188,301 B1 * 2/2001 Kornrumpf et al. ..... 333/262
6,239,685 B1 * 5/2001 Albrecht et al. ..... 337/365
6,703,916 B2 * 3/2004 Charvet et al. ..... 337/141
6,762,667 B2 * 7/2004 Volant et al. ..... 337/89
6,768,412 B2 * 7/2004 Becka et al. ..... 337/36
7,283,030 B2 * 10/2007 Cabal et al. ..... 337/36
2003/0006125 A1 * 1/2003 Hallbjorner ..... 200/36
2003/0029705 A1 2/2003 Qiu et al.
2004/0012062 A1 * 1/2004 Miyajima et al. ..... 257/419

FOREIGN PATENT DOCUMENTS

| | | |
|---|---|---|
| DE | 199 37 811 | 3/2001 |
| EP | 1 001 440 | 5/2000 |
| FR | 2 772 512 | 6/1999 |

* cited by examiner

*Primary Examiner*—Anatoly Vortman
(74) *Attorney, Agent, or Firm*—Oblon, Spivak, McClelland, Maier & Neustadt, P.C.

(57) ABSTRACT

A bistable MEMS microswitch produced on a substrate and capable of electrically connecting ends of at least two conductive tracks, including a beam suspended above the surface of the substrate. The beam is embedded at its two ends and is subjected to compressive stress when it is in the non-deformed position. The beam has an electrical contact configured to produce a lateral connection with the ends of the two conductive tracks when the beam is deformed in a horizontal direction with respect to the surface of the substrate. Actuators enable the beam to be placed in a first deformed position, corresponding to a first stable state, or in a second deformed position, corresponding to a second stable state, and the electrical contact ensures connection of the ends of the two conductive tracks.

15 Claims, 4 Drawing Sheets

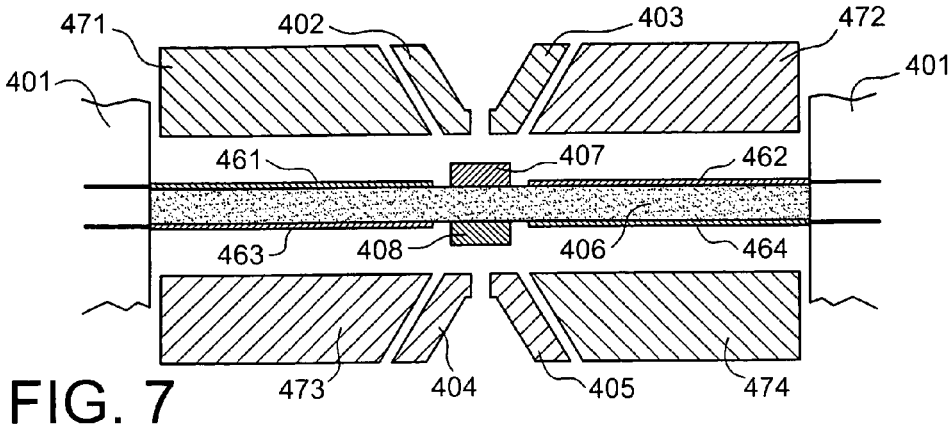
FIG. 7
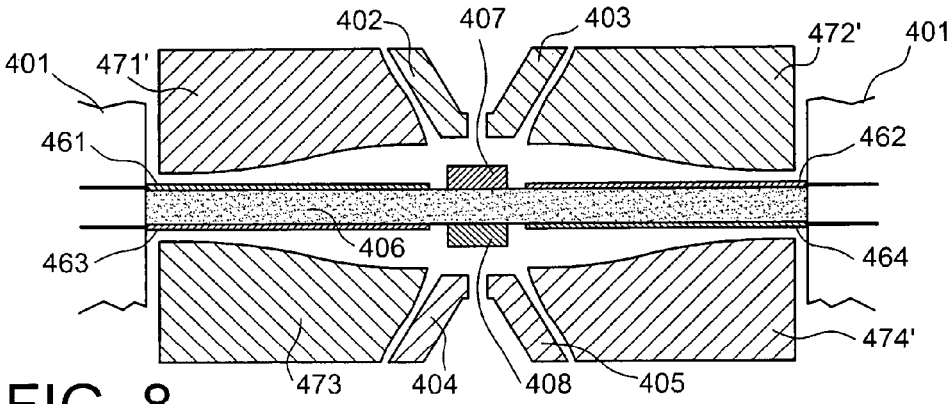
FIG. 8
FIG. 9
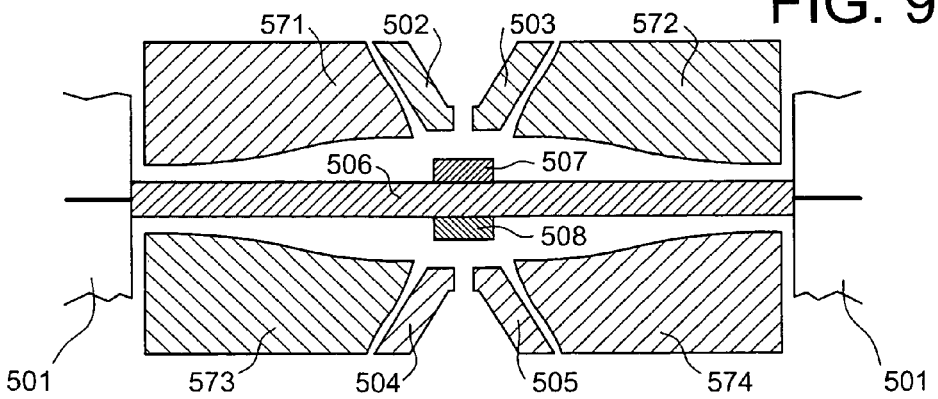

LOW POWER CONSUMPTION BISTABLE MICROSWITCH

TECHNICAL FIELD

This invention relates to a low consumption bistable microswitch with horizontal movement.

Such a microswitch is useful in particular in the field of mobile telephony and in the space field.

RF components intended for these fields are subject to the following specifications:

supply voltage below 5 volts, insulation greater than 30 dB, insertion losses below 0.3 dB, reliability corresponding to a number of cycles greater than $10^9$, surface smaller than 0.05 $mm^2$, lowest possible consumption.

In the case of the space field in particular, some switches are used only one time, to switch from one state to another state in the event of an equipment breakdown, for example. For this type of application, there is currently a very strong interest in bistable switches, which do not require a supply voltage once they have switched from one state to the other.

There is also a strong interest in dual switches, which considerably simplify the switch matrices of redundant circuits used in the case of critical functions. This type of application is seen in particular in the space field (satellite antennas). These dual switches make it possible to switch an input signal from one electronic circuit to another in the event of a breakdown. Therefore, these switches have the possibility of switching either a first set of two electrical tracks from one to the other, or a second set of two electrical tracks.

The dual switches have the advantage of enabling circuits comprising fewer components (for example, 10 redundancy functions require 10 dual switches rather than 20 single switches) to be produced, which means, among other things, fewer reliability tests, less assembly, increased space, and, overall, a lower cost.

BACKGROUND OF THE INVENTION

In the field of communications, conventional microswitches (i.e. those used in microelectronics) are very widely used. They are useful in signal routing, impedance-matching networks, amplifier gain adjustment, and so on. The frequency bands of the signals to be switched can range from several MHz to several dozen GHz.

Conventionally, microelectronic switches have been used for these RF circuits, which switches enable circuit electronics integration and have a lower production cost. In terms of performance, however, these components are rather limited. Thus, silicon FET switches can switch high-power signals at low frequencies, but not at high frequencies. MESFET (Metal Semiconductor Field Effect Transistor) switches made of GaAs or PIN diodes work well at high frequencies, but only for low-level signals. Finally, in general, above 1 GHz, all of these microelectronic switches have a significant insertion loss (conventionally around 1 to 2 dB) when on and rather low insulation in the open state (from −20 to −25 dB). The replacement of these conventional components with MEMS (Micro-Electro-Mechanical-System) microswitches is therefore promising for this type of application.

Owing to their design and operation principle, MEMS switches have the following characteristics:

low insertion losses (typically lower than 0.3 dB), high insulation in the MHz to millimetric range (typically over −30 dB), no response nonlinearity (IP3).

Two types of contact for MEMS microswitches are distinguished: ohmic contact and capacitive contact. In the ohmic contact switch, the two RF tracks are contacted by a short circuit (metal-metal contact). This type of contact is suitable both for continuous signals and for high-frequency signals (greater than 10 GHz). In the capacitive contact switch, an air space is electromechanically adjusted so as to obtain a capacitance variation between the closed state and the open state. This type of contact is particularly suitable for high frequencies (greater than 10 GHz) but inadequate for low frequencies.

Several major actuation principles for MEMS switches are distinguished.

Thermal actuation microswitches, which can be described as standard, are non-bistable. They have the advantage of a low actuation voltage. They have several disadvantages: excessive consumption (in particular in the case of mobile telephone applications), low switching speed (due to thermal inertia) and the need for a supply voltage to maintain contact in the closed position.

Electrostatic actuation microswitches, which can be described as standard, are non-bistable. They have the advantages of a high switching speed and a generally simple technology. They have problems of reliability, in particular in the case of low actuation voltage electrostatic switches (structural bonding). They also require a supply voltage in order to maintain contact in the closed position.

Electromagnetic actuation microswitches, which can be described as standard, are non-bistable. They generally operate on the principle of the electromagnet and essentially use iron-based magnetic circuits and a field coil. They have several disadvantages. Their technology is complex (coil, magnetic material, permanent magnet in some cases, etc.). Their consumption is high. They also require a supply voltage in order to maintain contact in the closed position.

Two configurations for moving the contact are differentiated: a vertical movement and a horizontal movement.

In the case of a vertical movement, the movement occurs outside the plane of the RF tracks. The contact occurs over the top or over the bottom of the tracks. The advantage of this configuration is that the metallization of the contact pad is easy to perform (flat deposit) and, therefore, the contact resistance is low. However, this configuration is poorly adapted for performing the function of dual contact switch. The contact over the top is indeed difficult to obtain. It is generally achieved by using a contact on the cap. This configuration also has poor integration compatibility. Indeed, for resistive switches, tracks and contacts with gold metallization are conventionally used (good electric properties, no oxidation). However, this metal is not integration compatible, even though it has been used since nearly the beginning of the technology for this type of configuration. There is no possible optimisation of the contact. Its surface can only be planar. The stiffness of the beam forming the contact is poorly controlled. This stiffness is conditioned by the final form of the beam which is dependent on the topology of a sacrificial layer which is itself dependent on the form and thickness of the tracks located below. The beam profile is generally irregular, which substantially increases the stiffness of the switch and therefore its actuation conditions.

In the case of horizontal movement, the movement takes place in the plane of the tracks. The contact takes place on the side of the tracks. This configuration is suitable for dual contact, with a symmetrical actuator. The "gold" metallization can be performed in the very last technological step. All of the preceding steps can be compatible with the production of integrated circuits. The form of the contact is determined in the photolithography step. For example, it is possible to have a round contact so that the contact occurs at one point and so as to thus limit the contact resistance. The form of the beam is determined in the photolithography step. Its stiffness is therefore well controlled. However, the metallization on the side is delicate. The contact resistance can therefore be poorly controlled. This configuration is unsuitable for electrostatic actuation due to the significantly-reduced opposing actuation surfaces.

The number of equilibrium states is another characteristic of the movement of the switches. In the standard case, the actuator has only one equilibrium state. This means that one of the two states of the switch (switched or unswitched) requires a continuous voltage supply in order to hold it in position. The interruption of the excitation causes the switch to move back to its equilibrium position.

In the bistable case, the actuator has two distinct equilibrium states. The advantage of this mode of operation is that the two "closed" and "open" positions of the switch are stable and do not require a power supply when there is no switching from one state to the other.

SUMMARY OF THE INVENTION

The invention proposes a low consumption bistable microswitch with horizontal movement. This microswitch is particularly suitable for the field of mobile telephony and the space field.

The subject matter of the invention is therefore a bistable MEMS microswitch produced on a substrate and capable of electrically connecting the ends of at least two conductive tracks, including a beam suspended above the surface of the substrate, wherein the beam is embedded at its two ends and subject to compressive stress when it is in the non-deformed position, and has electrical contact-forming means arranged to provide a lateral connection with the ends of the two conductive tracks when the beam is deformed in a horizontal direction with respect to the surface of the substrate, which microswitch has means for actuating the beam in order to move it either into a first deformed position, corresponding to a first stable state, or into a second deformed position, corresponding to a second stable state and opposite the first deformed position with respect to the non-deformed position, wherein the electrical contact-forming means ensure the connection of the ends of the two conductive tracks when the beam is in its first deformed position.

The microswitch can be a dual microswitch. In this case, the first deformed position corresponds to the connection of the ends of two first conductive tracks, and the second deformed position corresponds to the connection of the ends of two second conductive tracks.

It can be a single microswitch. In this case, the first deformed position corresponds to the connection of the ends of two conductive tracks, and the second deformed position corresponds to the absence of a connection.

According to a first embodiment, the beam is made of a dielectric or semiconductor material and the electrical contact-forming means are made of an electrically conductive pad integral with the beam. The actuation means of the beam can include thermal actuators using a bimetal effect. Each thermal actuator can then include a block of a thermally conductive material in close contact with an electrical resistance. The means for actuating the beam can include means for implementing electrostatic forces. They can include thermal actuators using a bimetal effect and means for implementing electrostatic forces.

According to a second embodiment, the beam is made of an electrically conductive material. The means for actuating the beam can then include means for implementing electrostatic forces.

The electrical contact-forming means can have a form enabling them to become embedded between the ends of the conductive tracks to be connected. In this case, the ends of the conductive tracks can have a flexibility enabling them to match the form of the electrical contact-forming means in a connection.

The microswitch can also include means forming a release spring for at least one of the embedded ends of the beam.

The electrical contact-forming means can be means providing an ohmic contact or means providing a capacitive contact.

BRIEF DESCRIPTION OF THE DRAWINGS

The invention can be better understood, and other advantages and special features will appear from the reading of the following description, given by way of non-limiting example, accompanied by the appended drawings, in which:

FIG. 7 is a top view of a fourth alternative of the dual microswitch according to the present invention, FIG. 8 is a top view of a fifth alternative of a dual microswitch according to the present invention, FIG. 9 is a top view of a sixth alternative of the dual microswitch according to the present invention.

DETAILED DESCRIPTION

The remainder of the description will relate, by way of example, to ohmic contact microswitches. However, a person skilled in the art can easily apply the invention to capacitive contact microswitches.

Figure 1:
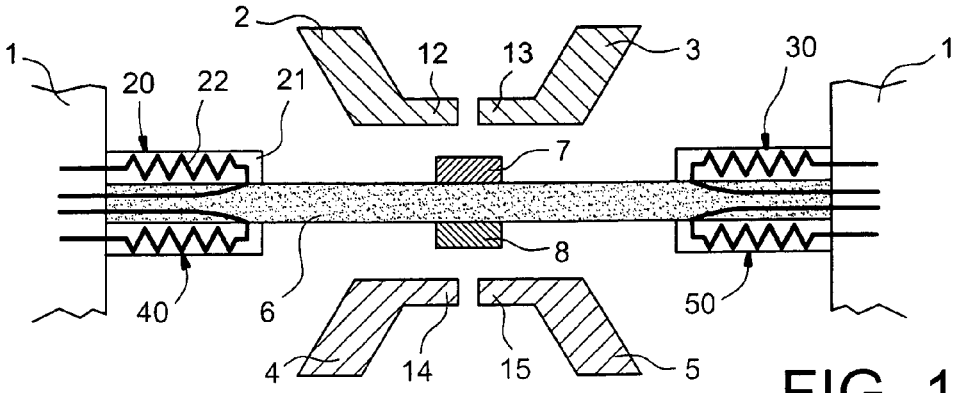
FIG. 1 is a top view of a first alternative of the dual microswitch according to the present invention.

FIG. 1 is a top view of a first alternative of the dual microswitch according to the first invention.

The microswitch is produced on a substrate 1 of which only a portion is shown for the sake of simplification. This microswitch is a dual switch. It is intended to produce a connection either between the ends 12 and 13 of conductive tracks 2 and 3, or between the ends 14 and 15 of conductive tracks 4 and 5.

The microswitch of FIG. 1 includes a beam 6 made of a dielectric or semiconductor material. It is located in the plane of the conductive tracks. The beam is embedded at its two ends in elevated portions of the substrate 1. It is shown in its initial position and is then subjected to a compressive stress. This stress can be caused by the intrinsic stresses of the materials used to form the mobile structure of the microswitch, i.e. the beam and the associated elements (actuators).

The beam shown has a rectangular cross-section. On its surface directed toward tracks 2 and 3 (i.e. on one of its sides), it supports actuators 20 and 30 and, on its surface directed toward tracks 4 and 5 (i.e. on its other side), it supports actuators 40 and 50. The actuators are located near the embedded areas of the beam. Each actuator consists of a thermally conductive block with an electrical resistance. Thus, the actuator 20 includes a block 21 to which a resistance 22 is connected. The same is true of the other actuators.

The beam is preferably made of a dielectric or semiconductor material with a low thermal expansion coefficient. The blocks of the thermal actuators are preferably made of a metal material with a high thermal expansion coefficient so as to obtain an efficient bimetal effect. As the movement of the beam occurs in the horizontal direction (the plane of the figure), the actuators are placed on the sides of the beam and near the embeddings, always for the purpose of thermomechanical efficiency.

The beam 6 also supports, in the central portion and on its sides, an electrical contact pad 7, intended to provide an ohmic electrical connection between the ends 12 and 13 of the tracks 2 and 3, and an electrical contact pad 8 between the ends 14 and 15 of the tracks 4 and 5.

Figure 2:
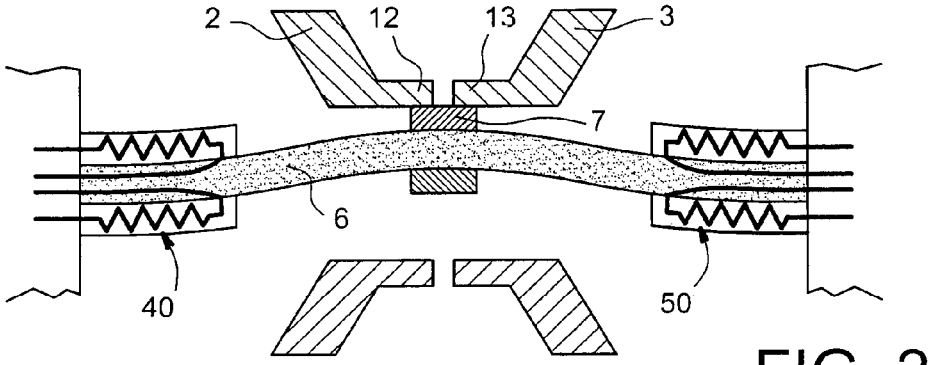
FIG. 2 shows the microswitch of FIG. 1 in a first stable operative state.

When the microswitch is activated, a first set of actuators enables the beam 6 to switch into a position corresponding to one of its two stable states. This is shown in FIG. 2. The actuators 40 and 50 create a bimetal effect in the beam 6, which is deformed so as to move into a first stable state shown in the figure. In this stable state, the electrical contact pad 7 provides a connection between the ends 12 and 13 of conductive tracks 2 and 3. The power supplies of the electrical resistances of the actuators 40 and 50 are interrupted and the beam remains in this first stable state.

Figure 3:
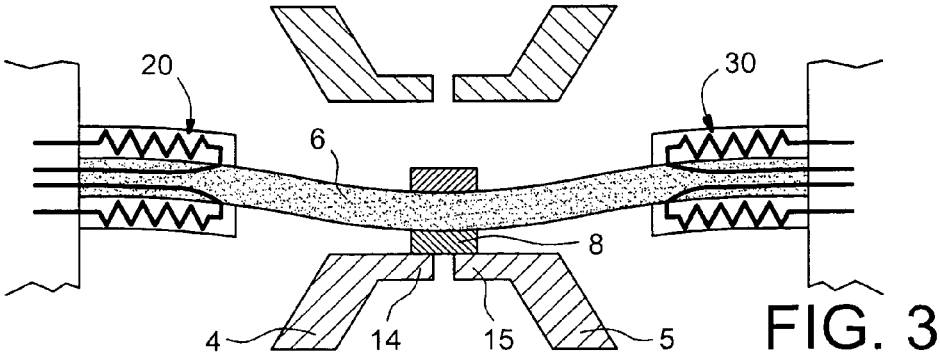
FIG. 3 shows the microswitch of FIG. 1 in a second stable operative state.

To switch the microswitch, i.e. to move it into its second stable state, the electrical resistances of the actuators 20 and 30 must be powered in order to induce a bimetal effect unlike the previous in the beam 6. The latter is deformed so as to move into its second stable state shown in FIG. 3. In this second stable state, the electrical contact pad 8 provides a connection between the ends 14 and 15 of conductive tracks 4 and 5. The power supplies of the electrical resistances of the actuators 20 and 30 are interrupted and the beam remains in this second stable state.

The electrical resistances of the actuators are preferably made of a conductive material with high resistivity. The conductive tracks and the contact pads are preferably made of gold for its good electrical properties and its reliability over time, in particular with regard to oxidation.

The embeddings of the beam may be either rigid (simple embedding), or more or less flexible by adjusting the configuration of the embeddings, for example, by adding release springs. The ability to adjust the flexibility of the beam enables the stresses in the beam to be controlled both initially (intrinsic stresses) and in order to go from one stable state to the other (passing through a buckling state). This has the advantage of limiting the risks of breakage of the beam, but also of enabling the consumption of the microswitch to be limited (lowering the switching temperature of the microswitch). The stresses of the beam can be relaxed only at one of its embedded ends or at both of its ends.

Figure 4:
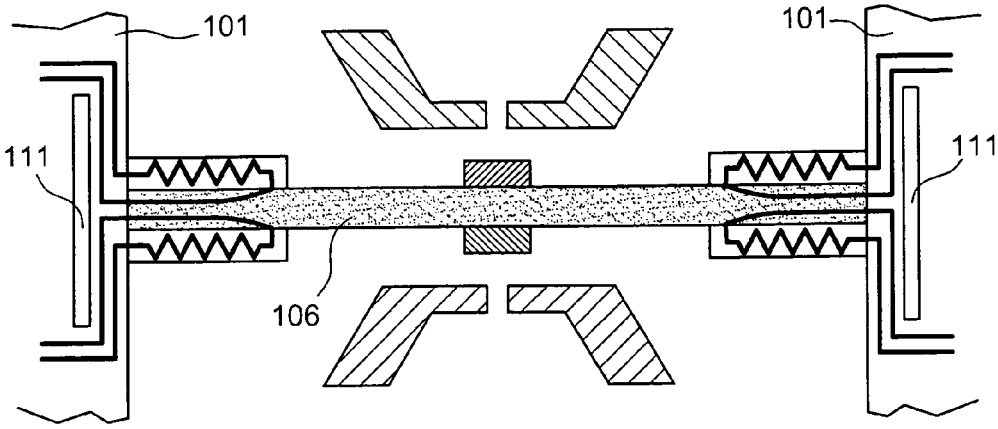
FIG. 4 is a top view of a second alternative of the dual microswitch according to the present invention.

FIG. 4 is a top view of a second alternative of a dual microswitch according to the present invention, and therefore the two ends of the beam have an embedding with stress relaxation.

The alternative embodiment of FIG. 4 includes the same elements as the alternative embodiment of FIG. 2, with the exception of the embedding of the ends of the beam. At this level, the substrate 1 has stress relaxation slots 111 perpendicular to the axis of the beam. The slots 111 provide a certain flexibility to the substrate portion located between said slots and the beam. The microswitch is shown in its initial position, before its activation.

The use of electrostatic forces can also be considered for the microswitch according to the invention, either as an actuation principle, or as an assistance in the switched position after interruption of the power supply of the electric heating resistors of the actuators, in order to increase the pressure of the electrical contact pad and thus limit the contact resistance.

Figure 5:
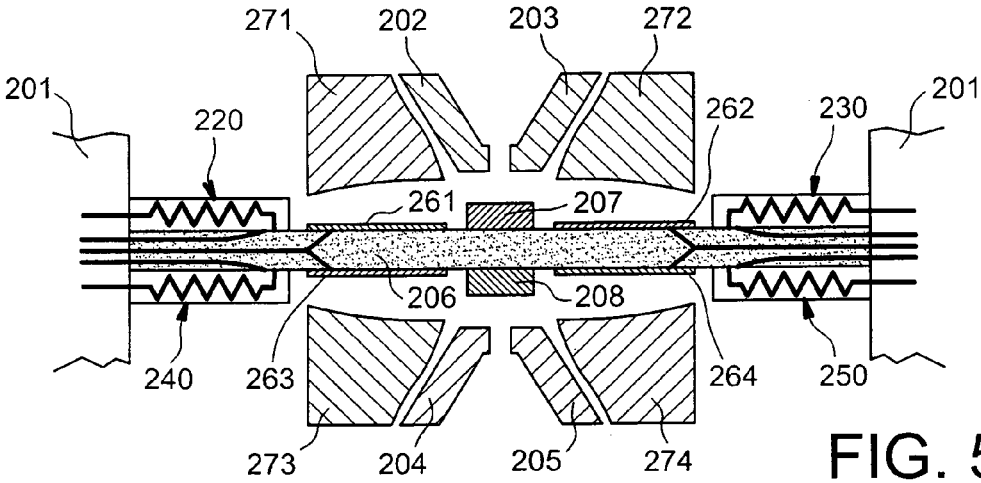
FIG. 5 is a top view of a third alternative of the dual microswitch according to the present invention.

FIG. 5 is a top view of a third alternative of a dual microswitch according to the present invention. This microswitch uses bimetal effect actuators and has electrostatic assistance. It is shown in its initial position, before its activation.

The substrate 201, tracks 202 and 203 to be connected by the contact pad 207 when the beam 206 is switched into a first stable state, tracks 204 and 205 to be connected by the contact pad 208 when the beam 206 is switched into a second stable state, and actuators 220, 230 and 240, 250, are recognised.

The microswitch of FIG. 5 also comprises electrodes enabling electrostatic forces to be applied. These electrodes are distributed on the beam and on the substrate. The beam 206 supports electrodes 261 and 262 on a first side, and electrodes 263 and 264 on a second side. These electrodes are located between the thermal actuators and the electrical contact pads. The substrate 201 supports electrodes 271 to 274 opposite each electrode supported by the beam 206. Electrode 271 has a portion opposite electrode 261, which portion is not visible in the figure, and a portion intended for its electrical connection, which part is visible in the figure. The same applies to electrodes 272, 273 and 274 with respect to electrodes 262, 263 and 264, respectively.

It is noted that electrodes 271 to 274 have a form that corresponds to the form of the deformed beam. This enables the actuation or maintaining voltages to be limited (variable gap electrodes).

The microswitch can be put in a first stable state, for example, corresponding to the connection of the conductive tracks 202 and 203 by the contact pad 207, by means of thermal actuators 240 and 250 which are activated only to obtain the first stable state. The application of a voltage between electrodes 261 and 271 and between electrodes 262 and 272 ensures a reduction in the contact resistance between the pads 207 and the tracks 202 and 203.

The microswitch can be put in the second stable state by means of actuators 220 and 230 which are activated only to obtain the switching from the first stable state to the second stable state. The application of a voltage between electrodes 263 and 273 and between electrodes 264 and 274 ensures a reduction in the contact resistance between the pad 208 and the tracks 204 and 205.

Figure 6:
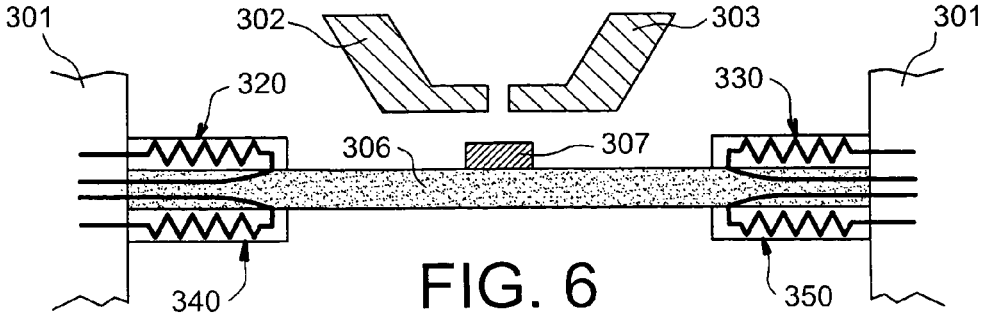
FIG. 6 is a top view of a single microswitch according to the present invention.

FIG. 6 is a top view of a single microswitch according to the present invention. This microswitch uses bimetal-effect actuators, without electrostatic assistance. It is shown in its initial position, before its activation.

The substrate 301 and tracks 302 and 303 to be connected by the contact pad 307 when the beam 306 is switched into a first stable state are recognised, and the second stable state corresponds to an absence of a connection. Actuators 320, 330 and 340, 350 are also recognised.

FIG. 7 is a top view of a fourth alternative of the dual microswitch according to the present invention. This microswitch uses only electrostatic-effect actuators. It is shown in its initial position, before its activation.

The substrate 401, tracks 402 and 403 to be connected by the contact pad 407 when the beam 406 is switched into a first stable state and tracks 404 and 405 to be connected by the contact pad 408 when the beam 406 is switched into a second stable state, are recognised.

The microswitch of FIG. 7 comprises electrodes enabling electrostatic forces to be applied. These electrodes are distributed over the beam and the substrate. The beam 406 supports electrodes 461 and 462 on a first side and electrodes 463 and 464 on a second side. These electrodes are located on each side of the electrical contact pads 407 and 408. The substrate 401 supports electrodes 471 and 474 opposite each electrode supported by the beam 406. The electrode 471 has a portion opposite the electrode 461, which portion is not visible in the figure, and a portion intended for its electrical connection, which is visible in the figure. The same applies to electrodes 472, 473 and 474 with respect to electrodes 462, 463 and 464, respectively.

The microswitch can be put in a first stable state, for example, corresponding to the connection of the conductive tracks 402 and 403 by the contact pad 407, by applying a voltage between electrodes 461 and 471 and between electrodes 462 and 472. Once the beam has switched into its first stable state, the applied voltage can be removed or reduced so as to reduce the contact resistance between the pad 407 and the tracks 402 and 403.

The microswitch can be put in the second stable state by applying a voltage between electrodes 463 and 473 and between electrodes 464 and 474 (and removing the electrostatic assistance voltage for keeping it in the first stable state if this assistance has been used). Once the beam has switched into its second stable state, the applied voltage can be removed or reduced, as above.

FIG. 8 is a top view of a fifth alternative of a dual microswitch according to the present invention. This fifth alternative is an optimised version of the previous alternative. The same references as in the previous line have been used to designate the same elements.

Electrodes 471', 472', 473' and 474' have the same function as the corresponding electrodes 471, 472, 473 and 474 of the microswitch of FIG. 7. However, they have a form that corresponds to the form of the deformed beam. This enables the actuation or maintenance voltages to be limited (variable gap electrodes).

FIG. 9 is a top view of a sixth alternative of a dual microswitch according to the present invention. It is shown in its initial position before its activation.

The substrate 501, tracks 502 and 503 to be connected by the contact pad 507 when the beam 506 is switched into a first stable state and tracks 504 and 505 to be connected by the contact pad 508 when the beam 506 is switched into a second stable state are recognised.

The beam 506 in this alternative is a metal beam, for example, made of aluminium, supporting contact pads 507 and 508 on its sides. The switching of the beam into a first stable state, for example, corresponding to the connection of the conductive tracks 502 and 503 is achieved by applying a switching voltage between the beam 506 acting as an electrode and electrodes 571 and 572. Once the beam has switched into its first stable state, the applied voltage can be removed or reduced so as to reduce the contact resistance between the pad 507 and the tracks 502 and 503.

The microswitch can be put in the second stable state by applying a voltage between the beam 506 and electrodes 573 and 574 (and removing the electrostatic assistance voltage for keeping it in the first stable state if this assistance has been used). Once the beam has switched into its second stable state, the applied voltage can be removed or reduced, as above. For this microswitch alternative, the electrostatic actuation has been optimised by the form given to electrodes 571 to 574.

Figure 10:
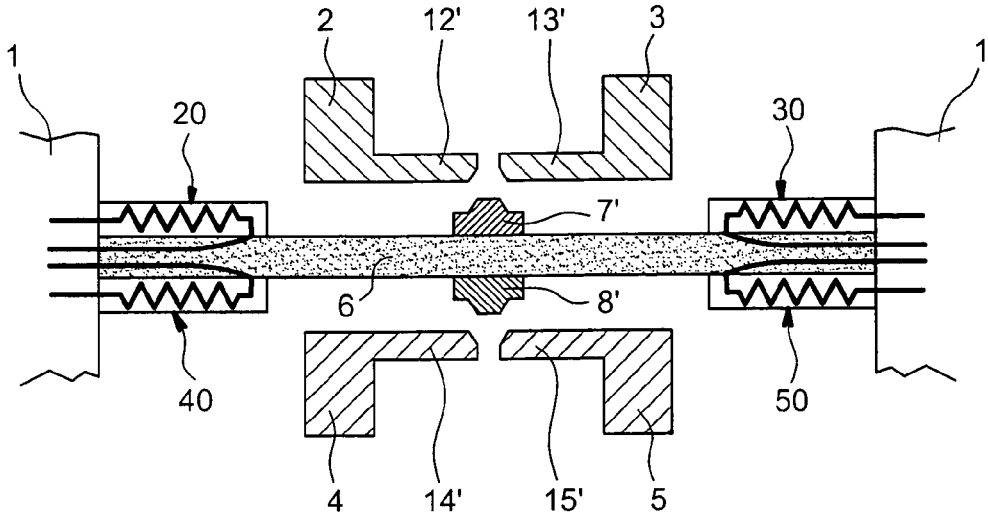
FIG. 10 is a top view of a dual microswitch corresponding to the first alternative but provided with optimised contacts.

FIG. 10 is a top view of a dual microswitch corresponding to the first alternative but provided with optimised contacts. The microswitch is shown in its initial position before its activation. The same references as in FIG. 1 have been used to designate the same elements.

It is noted in this figure that the ends 12', 13', 14' and 15' of conductive tracks 2, 3, 4 and 5, respectively, have been optimised in order to provide better electrical contact with the contact pads 7' and 8'. Thus, the contact pads 7' and 8' have a broader form at their base (i.e. near the beam) than at their top. They can thus be more easily embedded between the ends 12', 13', and 14', 15', which are provided with an embedding groove.

Figure 11:
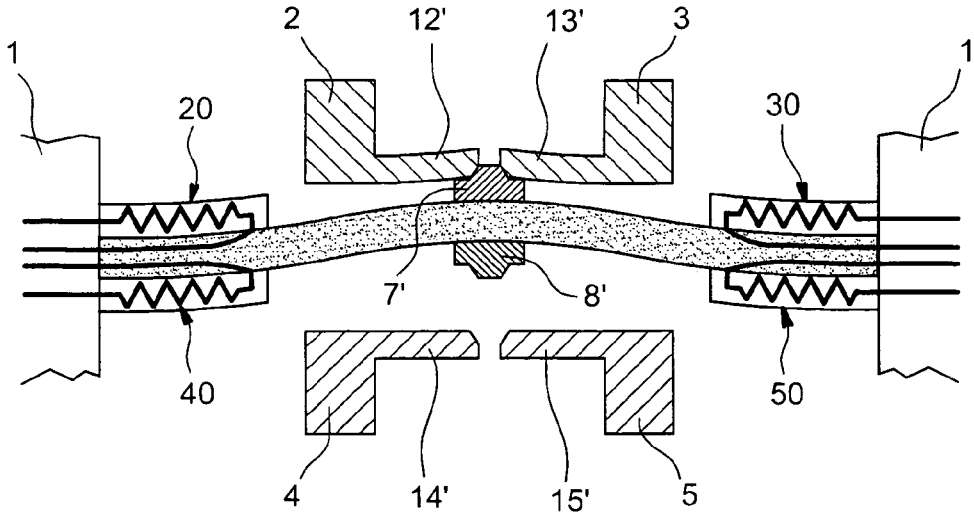
FIG. 11 shows the microswitch of FIG. 10 in a first stable operative state.

The ends of the conductive tracks can also be slightly flexible so a to match the form of the contact pad and thus provide better electrical contact. This is shown in FIG. 11, where the microswitch is shown in a first stable state.

The microswitch according to the present invention has the following advantages.

Its operation requires low consumption due to the bistability.

The alternatives with a thermal actuator have a high actuation efficiency. Their switching time is low insofar as it is not necessary for the temperature to rise very high in order to cause the beam to switch. They also have a low switching voltage when electrostatic actuators are connected to the thermal actuators. This is due to:

- the use of the thermal bimetal effect;
- the use of electric heating resistors integrated into the beam and located on (or in the close vicinity of) portions with a high thermal expansion coefficient of the bimetal (metal blocks) enabling the electrothermal efficiency to be as high as possible (lowest thermal losses);
- the use of a dielectric beam with low thermal conductivity, preventing significant heat dissipation outside the bimetal zone.

Therefore, the invention uses both the difference in thermal expansion of two different materials, and the application and conditioning of the temperature of the heating resistors at the level of the bimetal.

The invention provides the possibility of obtaining a dual switch.

It provides the possibility of obtaining a switch in which the contact resistance can be optimised:

- by the form which can be given to the contact pads and to the ends of the tracks to be switched, and optionally the flexibility of the, contact zone which allows for a more "suitable" contact between contact pads and tracks;
- by the possibility of adding "assistance" electrodes with a suitable form, which make it possible to obtain a high pressure on the contact pad with a low voltage at the terminals of these electrodes.

The production of microswitches according to the invention is highly compatible with the methods for producing integrated circuits ("gold" metallizations at the end of the production process, if necessary).

The bistability of the microswitch is perfectly controlled for two reasons. The first reason is that the bistability is obtained by the fact that the beam must be subjected to compression stress. This stress is created by the materials constituting the switch (form, thickness). If the beam is designed so as to be perfectly symmetrical, and if each of the two sets of actuators is produced in the same deposit, the stress can only be perfectly symmetrical (same form, same thickness and symmetry of the actuators). The result is a device likely not to favour one stable state over another state that would be less stable. The second reason is that it is possible to control the value of the compression stress by the type of deposit and also by the design, by adding stress release "springs".

The microswitch according to the invention can advantageously be produced on a silicon substrate. The embedded portion and the beam can be made of $Si_3N_4$, $SiO_2$ or polycrystalline silicon. The conductive tracks, contact pads, electrodes and thermal actuators can be made of gold, aluminium or copper, nickel, materials capable of being vacuum deposited or electrochemically deposited (electrolysis, autocatalytic plating). The heating resistors can be made of TaN, TiN or Ti.

For example, a method for producing an ohmic microswitch with thermal actuation on a silicon substrate can include the following steps:

deposition of an oxide layer of 1 μm of thickness by PECVD onto the substrate, lithography and etching of a cavity for the embedding, deposition of a polyimide layer of 1 μm of thickness, acting as a sacrificial layer, dry planarisation or chemical mechanical polishing (CMP) of the sacrificial layer, deposition of a $SiO_2$ layer of 3 μm of thickness, etching of said $SiO_2$ layer so as to obtain openings for the actuators, the contact pads and the conductive tracks, deposition of an aluminium layer of 3 μm of thickness, planarisation by CMP of the aluminium layer until the $SiO_2$ layer is uncovered, deposition of a $SiO_2$ layer of 0.15 μm of thickness, deposition of a TiN layer of 0.2 μm of thickness, lithographic etching of the heating resistors in the TiN layer, deposition of a $SiO_2$ layer of 0.2 μm of thickness, lithographic etching of this $SiO_2$ layer so as to obtain contact pads of the heating resistors, lithographic etching of the $SiO_2$, stopping at the sacrificial layer so as to obtain the beam, deposition of a Cr/Au bilayer of 0.3 μm of thickness, lithographic etching of the conductive tracks and contact pads, etching of the sacrificial layer so as to expose the beam.

According to another embodiment, a method for producing microswitch with thermal actuation on a silicon substrate can include the following steps:

deposition of an oxide layer of 1 μm of thickness by PECVD onto the substrate, lithographic etching of a cavity for the embedding, deposition of a polyimide layer of 1 μm of thickness, acting as a sacrificial layer, dry planarisation or chemical mechanical polishing (CMP) of the sacrificial layer, deposition of a $SiO_2$ layer of 3 μm of thickness, etching of said $SiO_2$ layer so as to obtain openings for the actuators, deposition of an aluminium layer of 3 μm of thickness, planarisation by CMP of the actuators, deposition of a TiN layer of 0.2 μm of thickness, lithographic etching of the heating resistors in the TiN layer, deposition of a $SiO_2$ layer of 0.2 μm of thickness, lithographic etching of this $SiO_2$ layer so as to obtain contact pads of the heating resistors, lithographic etching of said $SiO_2$ layer on a depth of 3.2 μm so as to obtain the beam, deposition of a Ti/Ni/Au trilayer of 1 μm of thickness, lithographic etching of the conductive tracks and contact pads, etching of the sacrificial layer so as to expose the beam.

The invention claimed is:

1. A bistable MEMS microswitch produced on a substrate and configured to electrically connect ends of at least two conductive tracks, including a beam suspended above a surface of the substrate, wherein the beam is embedded at ends thereof and is subjected to compressive stress when the beam is in a non-deformed position, the beam including an electrical contact-forming mechanism to produce a lateral connection with ends of the at least two conductive tracks when the beam is deformed, the microswitch comprising:

means for actuating the beam to place the beam either in a first deformed position corresponding to a first stable state, or in a second deformed position corresponding to a second stable state, the second deformed position opposing the first deformed position, wherein the microswitch is activated to urge the beam from an initial, non-deformed position to connect the electrical contact-forming mechanism to ends of the at least two conductive tracks.

2. A microswitch according to claim 1, wherein the microswitch is a dual microswitch, and the first deformed position corresponds to connection of ends of two first conductive tracks, and the second deformed position corresponds to connection of ends of two second conductive tracks.

3. A microswitch according to claim 1, wherein the beam is made of a dielectric or semiconductor material and the electrical contact-forming mechanism includes an electrically conductive pad integrated into the beam.

4. A microswitch according to claim 3, wherein the means for actuating the beam includes thermal actuators using a bimetal effect.

5. A microswitch according to claim 4, wherein each thermal actuator includes a block of thermally conductive material in contact with an electrical resistance.

6. A microswitch according to claim 3, wherein the means for actuating the beam includes means for implementing electrostatic forces.

7. A microswitch according to claim 3, wherein the means for actuating the beam includes thermal actuators using a bimetal effect and means for implementing electrostatic forces.

8. A microswitch according to claim 1, wherein the beam is made of an electrically-conductive material.

9. A microswitch according to claim 8, wherein the means for actuating the beam includes means for implementing electrostatic forces.

10. A microswitch according to claim 1, wherein the electrical contact-forming mechanism is configured to be embedded between the ends of the conductive tracks to be connected.

11. A microswitch according to claim 10, wherein the ends of the conductive tracks are flexible and conform to a deformation profile of the electrical contact-forming mechanism during a connection.

12. A microswitch according to claim 1, further comprising:

release spring-forming means for controlling a value of the compressive stress for at least one of the embedded ends of the beam.

13. A microswitch according to claim 1, wherein the electrical contact-forming mechanism provides an ohmic contact.

14. A microswitch according to claim 1, wherein the electrical contact-forming mechanism provides a capacitive contact.

15. A bistable MEMS microswitch produced on a substrate and configured to electrically connect ends of at least two conductive tracks, including a beam suspended above a surface of the substrate, wherein the beam is embedded at ends thereof and is subjected to compressive stress when the beam is in a non-deformed position, the beam including an electrical contact-forming mechanism to produce a lateral connection with ends of the at least two conductive tracks when the beam is deformed, the microswitch comprising:

means for actuating the beam to place the beam either in a first deformed position corresponding to a first stable state, or in a second deformed position corresponding to a second stable state, the second deformed position opposing the first deformed position, wherein the microswitch is a single microswitch and is activated to urge the beam from an initial, non-deformed position to the first deformed position to connect the electrical contact-forming mechanism to, ends of the at least two conductive tracks, and the second deformed position corresponds to an absence of a connection.

* * * * *